US008281605B2

(12) United States Patent
Williams et al.

(10) Patent No.: US 8,281,605 B2
(45) Date of Patent: Oct. 9, 2012

(54) BERNOULLI HEAT PUMP WITH MASS SEGREGATION

(75) Inventors: Arthur R. Williams, Holden, MA (US); Charles Agosta, Harvard, MA (US)

(73) Assignee: Machflow Energy, Ing., Worcester Hill, MA (US)

( * ) Notice: Subject to any disclaimer, the term of this patent is extended or adjusted under 35 U.S.C. 154(b) by 698 days.

(21) Appl. No.: 12/420,510

(22) Filed: Apr. 8, 2009

(65) Prior Publication Data

US 2009/0249806 A1 Oct. 8, 2009

Related U.S. Application Data

(60) Provisional application No. 61/123,339, filed on Apr. 8, 2008.

(51) Int. Cl.
*F25B 9/00* (2006.01)

(52) U.S. Cl. ..... 62/87; 62/238.7

(58) Field of Classification Search ..... 62/87, 116, 62/238.7, 324.2, 467, 500, 515; 165/122, 165/908

See application file for complete search history.

(56) References Cited

U.S. PATENT DOCUMENTS

| | | | | |
|---|---|---|---|---|
| 3,761,065 | A * | 9/1973 | Rich et al. | 261/76 |
| 4,378,681 | A * | 4/1983 | Modisette | 62/500 |
| 5,255,520 | A * | 10/1993 | O'Geary et al. | 62/3.2 |
| 5,734,552 | A * | 3/1998 | Krein | 361/695 |
| 5,816,056 | A * | 10/1998 | Ruffa | 62/119 |
| 6,032,464 | A * | 3/2000 | Swift et al. | 60/520 |
| 6,049,557 | A * | 4/2000 | Cunningham et al. | 372/59 |
| 6,371,200 | B1 * | 4/2002 | Eaton | 165/80.3 |
| 6,390,023 | B1 * | 5/2002 | Reynolds | 119/72 |
| 6,435,267 | B1 * | 8/2002 | Sterner | 165/96 |
| 6,474,409 | B1 * | 11/2002 | Sterner | 165/96 |
| 6,663,451 | B1 * | 12/2003 | Walczak | 440/89 R |
| 6,951,766 | B2 * | 10/2005 | Tanaka et al. | 438/12 |
| 7,028,753 | B2 * | 4/2006 | Sterner | 165/80.3 |
| 7,214,549 | B2 * | 5/2007 | Tanaka et al. | 438/5 |
| 7,219,715 | B2 * | 5/2007 | Popovich | 165/80.4 |
| 7,457,113 | B2 * | 11/2008 | Kumhyr et al. | 361/679.48 |
| 2002/0112784 | A1 * | 8/2002 | Tanaka et al. | 148/213 |
| 2003/0079366 | A1 * | 5/2003 | Chang | 34/96 |
| 2005/0175153 | A1 * | 8/2005 | Harding et al. | 378/143 |
| 2005/0199747 | A1 * | 9/2005 | Roarty | 239/135 |
| 2005/0206861 | A1 * | 9/2005 | Tanaka et al. | 355/30 |
| 2005/0206862 | A1 * | 9/2005 | Tanaka et al. | 355/30 |
| 2006/0077363 | A1 * | 4/2006 | Tanaka et al. | 355/30 |
| 2006/0078483 | A1 * | 4/2006 | Kemoun et al. | 422/188 |
| 2007/0277501 | A1 * | 12/2007 | Sorenson | 60/204 |
| 2008/0028774 | A1 * | 2/2008 | Williams et al. | 62/87 |
| 2008/0124668 | A1 * | 5/2008 | Schultz et al. | 431/89 |
| 2008/0203076 | A1 * | 8/2008 | Gelbart | 219/201 |
| 2009/0277192 | A1 * | 11/2009 | Williams et al. | 62/87 |

FOREIGN PATENT DOCUMENTS

| | | | |
|---|---|---|---|
| WO | WO 2006009844 | A2 * | 1/2006 |
| WO | WO 2006099052 | A2 * | 9/2006 |
| WO | WO 2007002496 | A2 * | 1/2007 |

* cited by examiner

*Primary Examiner* — Mohammad Ali
(74) *Attorney, Agent, or Firm* — Bingham McCutchen LLP

(57) ABSTRACT

Embodiments of a heat transfer apparatus, and related methods, involve a curved flow path, a heat source external to and in thermal communication with at least a portion of an inner radial boundary of the curved flow path, and a working fluid, including a heavier component and a lighter component, flowing through the flow path. The flow path causes the working fluid to experience centrifugal force so as to preferentially force the heavier component toward the exterior wall portion and thereby cause the lighter component to preferentially absorb heat from the interior wall portion.

56 Claims, 13 Drawing Sheets

BERNOULLI HEAT PUMP WITH MASS SEGREGATION

CROSS-REFERENCE TO RELATED APPLICATION

This application claims priority to, and the benefit of, U.S. Provisional Patent Application No. 61/123,339, filed on Apr. 8, 2008, the entire disclosure of which is hereby incorporated by reference.

TECHNICAL FIELD

In various embodiments, the invention relates to heat transfer systems, and more particularly to systems and methods for the transfer of heat between a heat source and a fluid passing a boundary wall in thermal communication with the heat source.

BACKGROUND

Heat transfer systems such as heat pumps may be used to move heat from a source to a sink, and may underlie, for example, the operation of air-conditioning systems and/or heating systems for buildings.

Heat transfer systems can be divided into two fundamental classes distinguished by the direction in which heat moves. In one class of heat transfer system, heat flows from higher temperatures to lower temperatures. This heat flow may, for example, be harnessed to produce mechanical work, as in internal-combustion engines. A second class of heat transfer device includes systems that move heat from lower temperatures to higher temperatures. Such systems are commonly called "heat pumps." Refrigerators and air conditioners, for example, are heat pumps.

Heat pumps necessarily consume power. In general, commonly used heat pumps employ a working fluid (gaseous or liquid) whose temperature is varied over a range extending from below that of the source to above that of the sink to which heat is pumped. The temperature of the working fluid is often varied by compression of the fluid. While conventional heat pumps may be effective in transferring or pumping heat, substantial power (in the form of mechanical work) is necessary to compress the fluid and facilitate heat transfer, making these systems relatively inefficient.

SUMMARY OF THE INVENTION

In various embodiments, the present invention relates to improved systems and methods for transferring heat between a heat source and a fluid. More particularly, embodiments of the invention include heat transfer systems (i.e., systems for moving heat from one location to another), such as, but not limited to heat pumps (i.e., systems that consume power to move heat from one location (a "source") to another, higher temperature location (a "sink" or "heat sink")), that utilize the "Bernoulli principle." In accordance with this principle, heat transfer between a heat source and a working fluid occurs as microscopic random molecular motion (temperature and pressure) is converted into directed motion (macroscopic fluid flow) while leaving the total kinetic energy unchanged. Whereas compression consumes power, Bernoulli conversion does not. Exploitation of the Bernoulli effect, therefore, substantially improves system efficiency relative to conventional, compression-based systems.

In addition, the present invention relates to improved systems and methods for minimizing the creation of entropy during fluid flow, thereby further improving the system efficiency relative to conventional, compression-based systems.

One aspect of the invention pertains to a heat transfer apparatus, embodiments of which include a first radially curved interior wall portion and a first radially curved exterior wall portion. The interior and exterior wall portions are spaced apart and define a first curved flow path therebetween. The apparatus further includes a first heat source external to and in thermal communication with at least a portion of the curved interior wall portion, and a working fluid that comprises a heavier component and a lighter component. The first flow path causes the working fluid to experience centrifugal force so as to preferentially force the heavier component toward the exterior wall and thereby cause the lighter component to preferentially absorb heat from the interior wall.

In one embodiment, the apparatus further includes a second radially curved interior wall portion and second radially curved exterior wall portion defining a second curved flow path. The second radially curved interior wall portion extends from the first radially curved exterior wall portion and the second radially curved exterior wall portion extends from the first radially curved interior wall portion so that the first and second flow paths define a single tortuous flow path. As a result, the working fluid experiences centrifugal force so as to preferentially force the lighter component toward the first interior wall along the first flow path and toward the second interior wall along the second flow path. The first radially curved interior wall portion and the second radially curved exterior wall portion may collectively be a portion of a unitary first structure, and the first radially curved exterior wall portion and the second radially curved interior wall portion may collectively be a portion of a unitary second structure. The first and second structures may have substantially symmetric cross-sections.

The first flow path may define a venturi shape. At least a portion of the curved interior wall portion may include a material having a high thermal conductivity, and the curved exterior wall portion may include a material having a lower thermal conductivity than the curved interior wall portion.

In one embodiment, at least one of the heavier component or the lighter component includes, or consists essentially of, a liquid and/or a gas. The gas may include, or consist essentially of, air, oxygen, a rare gas such as, but not limited to, helium or xenon, and/or mixtures thereof. For example, the lighter component may include, or consist essentially of, helium while the heavier component may include, or consist essentially of, xenon. The lighter component may have a mole fraction between 55% and 95% and, e.g., may have a mole fraction of approximately 75%.

The apparatus may include a drive system for driving the working fluid through the first flow path. The drive system may drive the working fluid through the first flow path at a core velocity of between 0.5 and 1.1 times the speed of sound of the working fluid and, e.g., at approximately 0.8 times the speed of sound of the working fluid.

The first heat source may include a heat-source flow path, which may extend substantially perpendicular to the first flow path. The interior wall portion may include at least one heat-conducting structure extending into the heat-source flow path and, for example, extending along an axis transverse to the flow path. The first radially curved exterior wall portion may also extend along the transverse axis. The heat-conducting structure may include a material having a high thermal conductivity.

In one embodiment, the apparatus further includes means defining a return flow path to transport the working fluid from an exit of the first flow path back to an entrance of the first flow path. The curved flow path and return flow path may define a closed loop. The return flow path may include a heat exchanger, e.g., to remove heat from the working fluid. Alternatively, the curved flow path may define an open loop flow path.

Another aspect of the invention includes a method of transferring heat. Embodiments of the invention include providing a first curved flow path and a first heat source external to and in thermal communication with at least a portion of an inner radial boundary of the first curved flow path. A working fluid, comprising a heavier component and a lighter component, is caused to flow through the first flow path, which causes the working fluid to experience centrifugal force so as to preferentially force the heavier component toward an exterior radial boundary of the first curved flow path and thereby cause the lighter component to preferentially absorb heat from the inner radial boundary. The first curved flow path may include a first radially curved interior wall portion and a first radially curved exterior wall portion. The interior and exterior wall portions are spaced apart and define the first curved flow path therebetween. The first radially curved interior wall portion may define the inner radial boundary of the first curved flow path.

In one embodiment, the method includes providing a second radially curved interior wall portion and second radially curved exterior wall portion defining a second curved flow path. The second radially curved interior wall portion extends from the first radially curved exterior wall portion and the second radially curved exterior wall portion extends from the first radially curved interior wall portion, so that the first and second flow paths define a single tortuous flow path. As a result, the working fluid experiences centrifugal force so as to preferentially force the lighter component toward the first interior wall along the first flow path and toward the second interior wall along the second flow path. The first radially curved interior wall portion and the second radially curved exterior wall portion may collectively define a portion of a unitary first structure, and the first radially curved exterior wall portion and the second radially curved interior wall portion may collectively define a portion of a unitary second structure. The first and second structures may have substantially symmetric cross-sections.

The first flow path may define a venturi shape. At least a portion of the curved interior wall portion may include a material having a high thermal conductivity, and the curved exterior wall portion may include a material having a lower thermal conductivity than the curved interior wall portion.

In one embodiment, the heavier component and/or the lighter component includes, or consists essentially of, a liquid and/or a gas. The gas may include, or consist essentially of, air, oxygen, a rare gas such as, but not limited to, helium or xenon, and/or mixtures thereof. For example, the lighter component may include, or consist essentially of, helium while the heavier component may include, or consist essentially of, xenon. The lighter component may have a mole fraction between 55% and 95% and, e.g., may have a mole fraction of approximately 75%.

The method may include providing a drive system for driving the working fluid through the first flow path. The drive system may drive the working fluid through the first flow path at a core velocity of between 0.5 and 1.1 times the speed of sound of the working fluid and, e.g., at approximately 0.8 times the speed of sound of the working fluid.

The first heat source may include a heat-source flow path. The heat-source flow path may extend substantially perpendicular to the first flow path. The interior wall portion may include at least one heat-conducting structure extending into the heat-source flow path and, for example, extending along an axis transverse to the flow path. The first radially curved exterior wall portion may also extend along the transverse axis. The heat-conducting structure may include a material having a high thermal conductivity.

In one embodiment, the method further includes providing means defining a return flow path to transport the working fluid from an exit of the first flow path back to an entrance of the first flow path. The curved flow path and return flow path may define a closed loop. The return flow path may include a heat exchanger, e.g., to remove heat from the working fluid. Alternatively, the curved flow path may define an open loop flow path.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

In general, the present invention relates to heat transfer systems, and more particularly to Bernoulli heat pumps for use in transferring heat from a heat source to a working fluid.

Figure 1A:
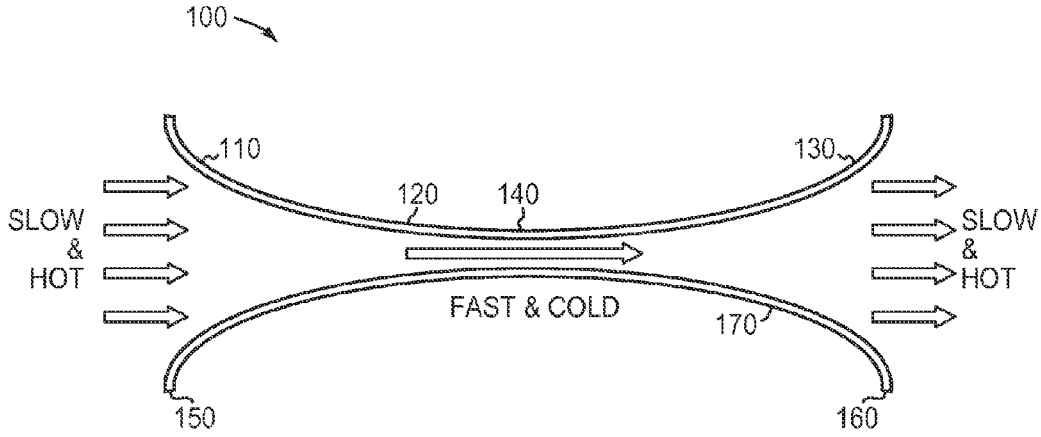
FIG. 1A shows a schematic side view of a venturi shaped flow, in accordance with one embodiment of the invention.
Figure 1B:
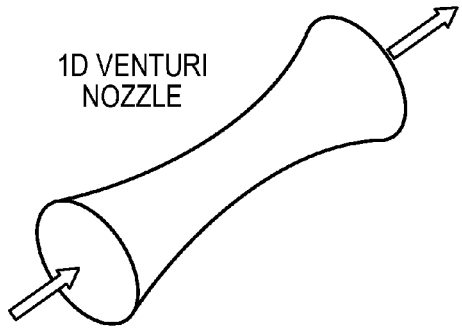
FIG. 1B shows a schematic perspective view of a cylindrical venturi nozzle, in accordance with one embodiment of the invention.
Figure 1C:
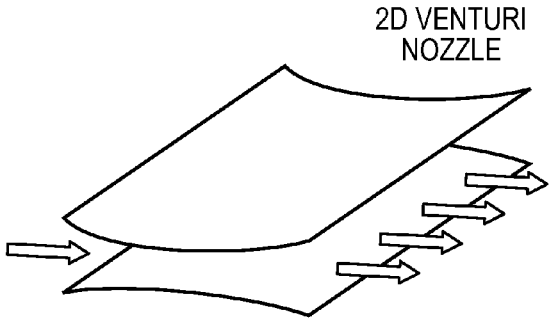
FIG. 1C shows a schematic perspective view of a two-dimensional venturi nozzle, in accordance with one embodiment of the invention.

One embodiment of the invention includes a venturi-shaped channel through which a working fluid can flow in accordance with the Bernoulli principle. An exemplary venturi 100 is shown in FIG. 1A. The venturi 100 includes an inlet portion 110, a neck portion 120 (e.g., a region of the flow-path with a heat-exchanging boundary 120 and/or 140 connecting the region of decreasing cross-sectional area to the region of increasing cross-sectional area), and a diffuser or outlet portion 130. The cross-sectional area of the venturi 100 decreases from the inlet portion 110 to the neck portion 120 and increases, after passing an apex 140 of the neck portion 120, in the outlet portion 130. The venturi 100 may have any appropriate cross-sectional shape such as, but is not limited to, a circular, oval, square, or rectangular cross-section. The cross-sectional shape may be constant along the length of the venturi 100. Alternatively, depending on the application, the cross-sectional shape may vary along the length of the venturi 100. For example, the cross-section of the venturi 100 may be substantially circular at an apex 140 of the neck portion 120 while being substantially square at an outer edge 150 of the inlet portion 110 and/or an outer edge 160 of the outlet portion 130. An exemplary venturi nozzle 100 with a cylindrical cross-section (e.g., a venturi nozzle with a cross-sectional area varying along a length thereof) is shown in FIG. 1B, while an exemplary venturi nozzle 100 with a rectangular cross-section (e.g., a venturi nozzle with a cross-sectional area varying along a length thereof due to a variation of only one dimension of the cross-section) is shown in FIG. 1C.

In operation, a working fluid enters the venturi 100 through the inlet portion 110. As the cross-sectional area of the venturi 100 decreases towards the neck portion 120, the directed motion of particles within the working fluid must increase in order to maintain a constant mass flux. Such conversion occurs, without the addition of energy, by the local reduction of the random molecular motion of the particles. As a result, as the cross-sectional area decreases, the temperature and pressure of the working fluid decrease, while the velocity of the working fluid increases. Whereas compression consumes power, Bernoulli conversion does not. Though Bernoulli conversion itself consumes no power, the fluid nozzling may result in relatively strong velocity gradients within the working-fluid flow, which may result in some viscous loss. After passing through the neck portion 120, the cross-sectional area of the venturi 100 increases, resulting in a reduction in fluid velocity and a corresponding increase in pressure and temperature.

Therefore, as the working-fluid flows through the central neck portion 120 of the venturi 100, the velocity of the fluid increases while the temperature decreases. After the working fluid has substantially passed the apex 140 of the central neck portion 120, or a location slightly downstream of the apex 140, the velocity of the working fluid decreases while the temperature increases. As a result, a venturi 100 may be used to quickly and efficiently reduce the temperature of a working fluid in the vicinity of the neck portion 120. Placing a heat source at or near the neck portion 120 allows the venturi 100 to act as a heat transfer system, with heat being passed from the heat source to the working fluid at the neck portion 120 as long as the temperature of the working fluid at the neck portion 120 is lower than that of the heat source (regardless of whether the temperature of the working fluid entering the inlet portion 110 is higher than that of the heat source). In various embodiments, the heat source is located within the neck portion 120, in the outlet portion 130 downstream of the neck portion 120, or extending between both the neck portion 120 and the outlet portion 130.

In one embodiment, the venturi 100 is operated by driving the working fluid through a flow path defined by or including a boundary wall 170. The boundary wall 170 is continuous with or part of the venturi structure (e.g., partially or completely surrounding an axial segment of the venturi 100), and may be formed from any appropriate material including, but not limited to, a metal, a ceramic, a plastic, or a composite material. In an alternative embodiment, the flow path including the venturi 100 may be self-forming, for example, by directing gas through a small aperture.

Figure 2:
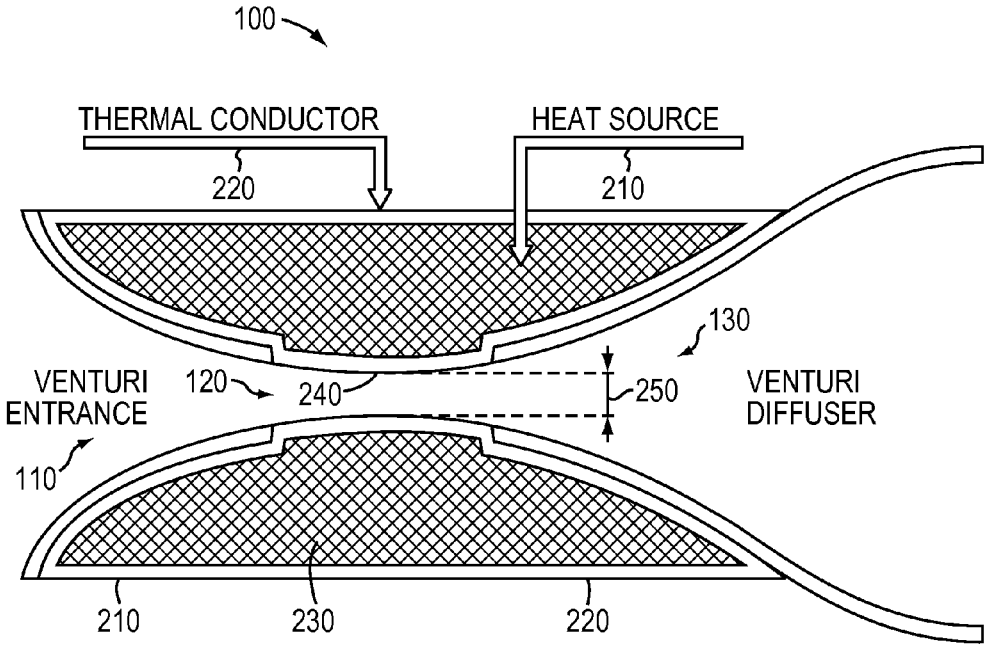
FIG. 2 shows a schematic side view of a heat transfer system including a venturi flow, in accordance with one embodiment of the invention.

An exemplary venturi 100 including a heat source in thermal communication with a neck portion 120 of the venturi 100 is shown in FIG. 2. In this embodiment, a working fluid is driven from an inlet portion 110, through the neck portion 120, and out through an outlet portion 130. A heat source 210 partly or completely surrounds the neck portion 120 and is in thermal communication therewith. The heat source 210 may be a source of air to be cooled, such as an interior air flow in a building, for an air conditioning system. Alternatively, the heat source may include a recirculating cooling fluid for a mechanical device, a pipe flow in a fluid transport system (such as, for example, an oil or gas piping system), a mixed-phase fluid flow, or any other appropriate fluid flow or solid heated material requiring cooling. Exemplary heat sources may include components for electrical systems and/or vehicles, such as aircraft or ground transportation.

In the illustrated embodiment, the heat source 210 includes a channel 220 through which a heated fluid 230 is flowed. The channel 220 (or the portion in thermal communication with the neck portion 120) may include or consist of a material selected to provide a high thermal conductivity between the heat source 210 and the working fluid within the venturi 100. A material has sufficiently high thermal conductivity if it exceeds that of one or more surrounding materials in thermal communication therewith. Exemplary materials include, but are not limited to, metals (e.g., copper or aluminum), graphite-based materials, textured surfaces, including nano-textured surfaces, and/or carbon nano-tube based materials. In one embodiment, the channel 220 may include or consist essentially of a material such as, but not limited to, a metal such as copper, steel, aluminum, a ceramic, a composite material, or combinations thereof.

The channel 220 may be constructed from a single material or from a plurality of materials. For example, one embodiment of the invention includes a channel 220 having a high thermal conductivity in contact with the neck portion 120 of the venturi 100; elsewhere, the flow path has a lower thermal conductivity, or even exhibits a high degree of thermal insulation.

In an alternative embodiment, the heat source 210 is a solid block of material, without a channel defined therethrough, such as, but not limited to, a metal such as copper, steel, aluminum, a ceramic, a composite material, or combinations thereof. The material is selected to provide a high thermal conductivity between the heat source 210 and the working fluid within the venturi 100. The solid block heat source 210 relies on conduction through the material to transport heat from a source to the neck portion 120 of the venturi 100.

In one embodiment, a portion 240 of the channel 220 is embedded within the boundary wall 170 of the venturi 100, such that the channel is in direct physical contact with the working fluid within a portion of the venturi 100, e.g., within the neck portion 120. In an alternative embodiment, the heat source 210 is placed against a sealed boundary wall 170 of the venturi 100, such that any heat transferred between the heat source 220 and the working fluid must pass through the boundary wall 170.

The heat source 210 may have any appropriate cross-sectional shape. For example, as shown in FIG. 2, the heat source 210 may conform to the boundary wall 170 of the venturi 100 along a portion thereof. Alternatively, the heat source 210 may have any desired cross-sectional shape such as, for example, a circular, oval, square, or rectangular cross-section.

In operation, heat is transferred from the heat source 210 to the working fluid as it passes through the neck portion 120 of the venturi 100 (i.e., the portion of the venturi 100 where the velocity is at or near a maximum and the temperature is at or near a minimum). Because convection is orders of magnitude more effective than conduction in transferring heat, the surface area of the channel portion 240 exposed to the working-fluid flow can be much smaller than that exposed to the heat-source flow. As a result, the entire channel 220 may be formed from a material exhibiting a high thermal conductivity (e.g., a metal), thereby allowing heat to be conducted from the heat-source fluid 230 to the channel 220 over the entire outer extent of the channel 220, after which the heat is transferred from the channel 220 to the working fluid within the venturi 100 through the exposed channel portion 240.

Figure 3:
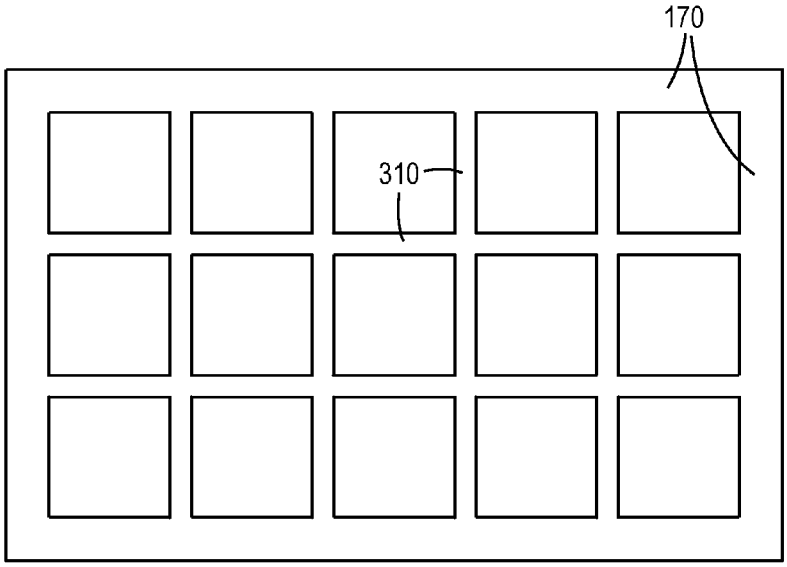
FIG. 3 shows a plan view of a grid structure for a heat transfer system including a venturi flow, in accordance with one embodiment of the invention.

One or more heat-conducting structures (e.g. fins, grids, and/or porous structures), may extend from the channel portion 240 into either the working fluid within the venturi 100 and/or into the heat-source fluid 230 to provide additional surface area over which heat transfer can take place. These heat-conducting structures may have any appropriate size and shape, and may be formed from any of the thermally conducting materials described herein. An exemplary fin structure for placement within the neck portion 120 of a venturi 100 is shown in FIG. 3. In this embodiment, fins 310 extend from the boundary wall 170 of the venturi 100 and are arranged in a grid pattern. The fins may, for example, be formed from the same material as the heat source channel 220 (in the case of a fluid flow based heat source) or of the same material as the heat source 210 itself (for a solid heat source). In one embodiment, the fins 310 extend from the exposed channel portion 240 at the apex 140 of the venturi 100. More generally, any appropriate number, arrangement and placement of fins may be used. The fins may be hollow to allow the heated fluid to be cooled 230 within the heat source channel 220 to flow through the fins.

The cross-sectional height 250 of the apex 140 of the neck portion 120 may be substantially smaller than the width of the cross-section at the apex 140, thereby allowing heat to be transferred between the heat source 210 and the working fluid within the venturi 100 over a substantial area.

In one embodiment, the venturi 100 is part of an open-loop system, such that the working fluid is entrained from the surrounding atmosphere and exhausted to the surrounding atmosphere after being driven through the venturi 100. In this embodiment, the working fluid may include, or consist essentially of, air, one or more high-gamma (heat-capacity ratio) and/or low-$C_p$ (specific heat at a constant pressure) gases, one or more rare gases, particles of one or more solid materials, or mixtures thereof. A high-gamma gas is one having a value of gamma greater than that of air, while a low-$C_p$ gas is one having a value of $C_p$ lower than that of air. In another embodiment (for example, an implementation designed for underwater heat transfer), the working fluid may include, or consist essentially of, water, one or more high-gamma and/or low-$C_p$ gases, one or more rare gases, particles of one or more solid materials, or mixtures thereof. But more generally, any suitable gaseous or liquid working fluid may be utilized. The suitability of a working fluid may be determined by factors including, but not limited to, the thermal properties of the material, viscosity, toxicity, expense, and/or scarcity. In one embodiment, working fluids having lower values for specific heat are advantageous, at least because the specific heat determines the magnitude of the temperature drop produced by a given flow speed. Suitable fluids include, but are not limited to, those having high thermal conductivity, low viscosity, appropriate gas-liquid transition temperatures, low cost (e.g., to manufacture and handle), and/or meeting required environmental standards. The working fluid may be driven through the venturi 100 by a fan, pump, blower, or other appropriate fluid drive system, placed either upstream of the venturi 100 (i.e., before the inlet portion 110) or downstream of the venturi 100 (i.e., after the outlet portion 130).

In an alternative embodiment, the venturi 100 is part of a closed-loop system wherein, upon exiting the outlet portion 130 of the venturi 100, the working fluid is recirculated back to the inlet portion 110. As the working fluid in a closed-loop system is not exhausted to the surrounding atmosphere, fluids which may be environmentally damaging, but which provide improved heat transfer characteristics over air, may be utilized. In order to remove the heat transferred to the working fluid from the heat source 210, one or more heat exchangers may be incorporated into a return leg of a closed-loop system.

Figure 4A:
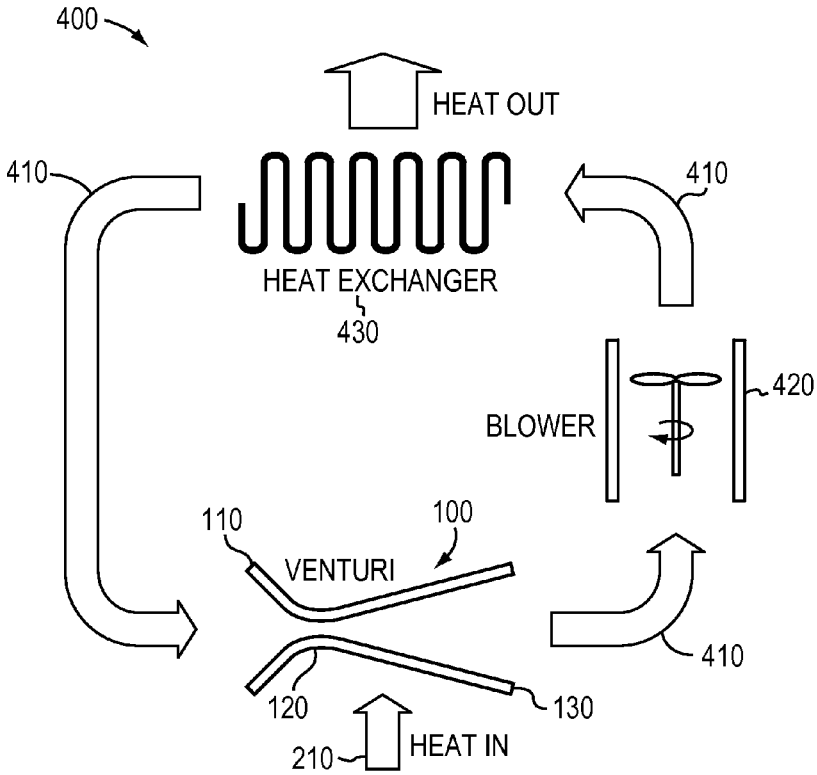
FIG. 4A shows a schematic view of a closed-loop heat transfer system including a venturi flow, in accordance with one embodiment of the invention.

FIG. 4A illustrates an exemplary closed-loop heat transfer system incorporating a return leg that includes a heat exchanger. In this embodiment, the heat transfer system 400 includes a venturi 100 through which a working fluid is driven, as described above. A heat source 210 is placed in thermal contact with the neck portion 120 of the venturi 100; heat is transferred from the heat source 210 to the working fluid as it is driven through the venturi 100. Upon exiting the outlet portion 130 of the venturi 100, a fluid return path 410 carries the working fluid back to the inlet portion 100 of the venturi 100. This fluid return path 410 may include, for example, a closed duct system through which the fluid is free to travel. One or more means of driving the working fluid around the fluid return path 410 and through the venturi 100 may be placed at any appropriate location within the system 400. For example, the embodiment shown in FIG. 4A includes a blower fan 420 located downstream of the venturi 100. More generally, any suitable fluid driving system may be used including, but not limited to, blowers, fans, pumps, turbines, and/or jets. Indeed, multiple fluid driving means—e.g., a plurality of blower fans 420 positioned at various locations around the closed fluid return flow path 410—may be used.

One or more heat exchangers 430 may be placed along the fluid return path 410 to remove the heat transferred to the working fluid from the heat source 210. The form of heat exchanger 430 is not critical to the present invention. Suitable configurations include, but are not limited to, parallel-flow heat exchangers, cross-flow heat exchangers, counter-flow heat exchangers, shell-and-tube heat exchangers, plate heat exchangers, regenerative heat exchangers, adiabatic wheel heat exchangers, plate-fin heat exchangers, multi-phase heat exchangers, spiral heat exchangers, or combinations thereof. This heat exchanger 430 may, for example, take heat from the working fluid and vent it to the surrounding atmosphere.

The heat transfer system 430 may be used, for example, in an air-conditioning system, where heat is to be removed from the interior of a building and vented to the exterior of the building. In this embodiment, the heat source may include a flow of interior building air which is driven through one or more venturis 100. Heat from the interior air is transferred to the working fluid, after which the interior air is exhausted back into the building. The heat transferred to the working fluid can then be removed from the working fluid by the heat exchanger 430, which vents the heat to the atmosphere outside the building. Alternatively, the heat from the working fluid may be utilized for other purposes, e.g., local or special-purpose heating, or power generation.

In alternative embodiments, heat transfer systems according to the invention include a plurality of venturis 100, heat sources 210, heat exchangers 430, and/or flow paths 410. Heat transfer systems according to the invention may also include both open-loop flow paths and closed-loop flow paths for either the working fluid and/or a heat-source fluid flow.

In one embodiment, additional (and conventional) control devices are incorporated into the system to control elements of the working-fluid flow including, but not limited to, the velocity, the pressure, the temperature, the humidity, and the volume and/or proportions of individual components of the working fluid. Measurement devices may also be incorporated into the system to monitor performance characteristics of the system including, but not limited to, the temperature, velocity, pressure, and properties and/or proportions of the individual components of the working fluid. In one embodiment, a control system receives data from the measurement device(s) and utilizes these to operate the control devices in order to optimize the performance of the system, continuously and in real-time. The control system may also respond to user inputs.

Figure 4B:
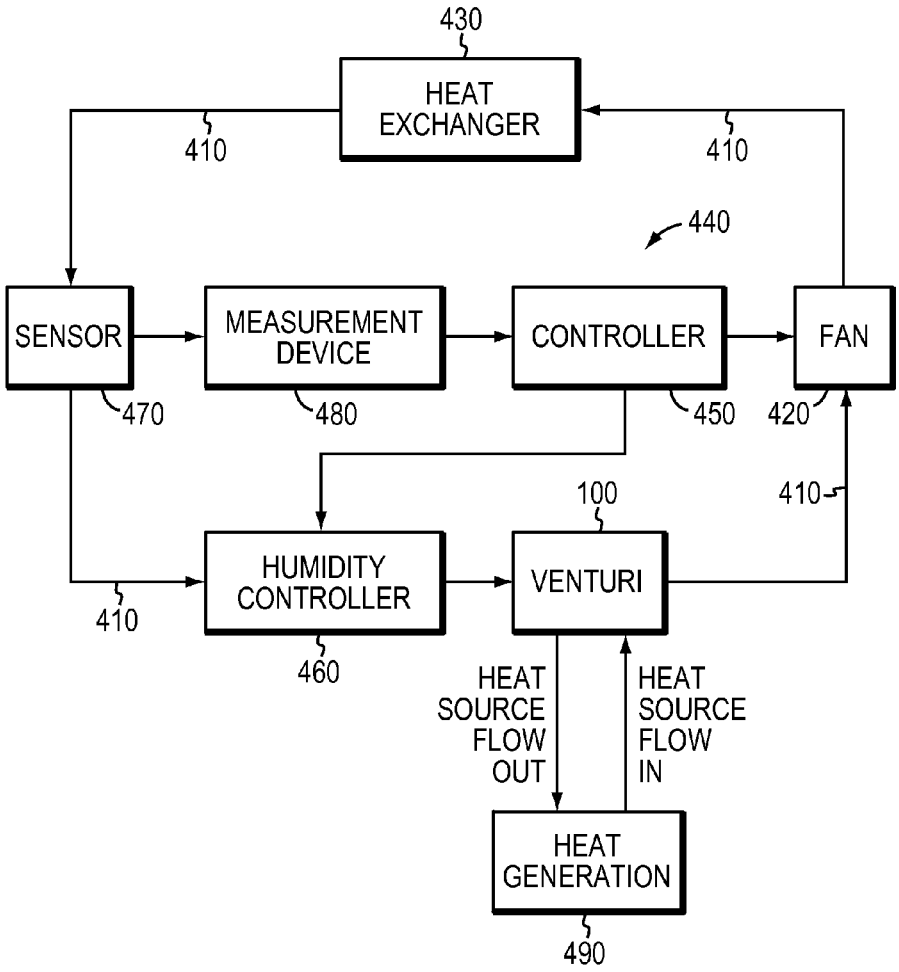
FIG. 4B shows a schematic view of the closed-loop heat transfer system of FIG. 4A, further including a control system.

An exemplary heat transfer system 400 including a control system 440 is shown in FIG. 4B. The control system 440 includes a controller 450 (e.g., an electronic controller such as a computer, and/or a mechanical controller) that controls the functionality of a humidity controller 460 and/or a fan 420. The humidity controller 460, or other appropriate flow-control element, controls the injection of a second fluid component into the working-fluid flow. In one embodiment, no humidity controller is required. The control system 440 also includes at least one sensor 470 for sensing at least one parameter of the working-fluid flow (such as, but not limited to, temperature, flow rate, pressure, density, humidity, and/or chemical composition). The sensor(s) 470 may be placed at any appropriate location within the heat transfer system 400, such as in the return flow path 410 upstream of the venturi 100. The sensor 470 is coupled to a measurement device 480 which receives raw signals from the sensor 470 and converts these to a digital value indicative of the sensed parameter. The measurement device 480 sends this reading value to the controller 450. In an alternative embodiment, the sensor 470 may communicate directly with the controller 450, without the need for a discrete measurement device 480 therebetween. In operation, the control system 440 controls at least one parameter of the working-fluid flow to assist in controlling the transfer of heat between the working fluid and the heat-source flow (from a heat-generation source 490 such as, for example, the interior air flow of a building).

In one embodiment, a pressure-control system may be used in a closed-loop system to control the pressure of the working fluid within the system. For example, a pressure-control system may pressurize the working fluid within the system to either above or below atmospheric pressure. In one embodiment, the working fluid is pressurized to between 1.2 and 1.8 atmospheres, and more typically to a pressure of between 1.4 and 1.6 atmospheres. In an exemplary embodiment, the working fluid is pressurized to approximately 1.5 atmospheres. A heat transfer system in accordance with the invention may include a plurality of venturis 100, which may, for example, be stacked together to form the heat transfer system. This system may be used, for example, in an automobile radiator.

The efficiency of a Bernoulli heat pump is, in general, limited by factors such as the entropy increase associated with the exhaust of heat at a temperature above that at which the heat was acquired, the entropy increase due to turbulent flow in the diffuser section, and/or the entropy increase due to the variation of the flow speed across the boundary layer at the venturi wall (which, in turn, is related to the viscosity multiplied by the square of the velocity gradient). More particularly, due to the effects of viscosity, Bernoulli conversion is not fully reversible. That is, that after passing through the neck of the venturi, the flow does not simply return to the same flow conditions that it had upstream of the neck portion. Rather, the fluid dynamics of flow upstream and downstream of the neck of the venturi are quite different, especially with regard to the sign of the pressure gradient and the stability of the flow with respect to turbulence.

If the flow remains laminar downstream of the neck, then its cross-sectional area does not spontaneously increase. The result is called a "laminar jet." The "unfavorable" sign (>0) of the longitudinal pressure gradient downstream of the neck renders laminar flow unstable. If any condition (e.g., surface roughness) triggers the transition, the flow becomes turbulent, and its cross-sectional area increases. While the dramatic increase in effective viscosity that accompanies the transition to turbulent flow increases the cross-sectional area of the flow, it also increases the irreversible dissipation. For example, experimental data for so-called "critical flow venturis" (CFVs) suggests that the pressure recovery for Mach-1 venturis is limited to approximately 90%; that is, a pressure drop of 10% across the venturi is required to maintain the flow, even if the venturi surface is very smooth. The power consumed maintaining the flow is proportional to this pressure drop; the coefficient of proportionality is the volume flow rate.

Bernoulli heat pumps may be either open-loop or closed-loop. In general, both open and closed systems require a venturi and a source of shaft work to maintain flow through the venturi. The shaft work may be provided, for example, by an axial blower. Open and closed systems differ in the disposition of the heat transferred to the working fluid in the venturi neck. In open systems, the working fluid emerging from the venturi and the heat that has been transferred to it are simply exhausted into the environment. In closed systems, the working fluid is not discharged, but rather is returned to the entrance of the venturi for repeated use. While closed systems offer greater choice with regard to the fluids used, they generally require removal of the heat transferred to the working fluid (e.g., by a heat exchanger), as discussed, for example, with respect to FIGS. 4A and 4B. The heat transferred into and out of the working fluid by the heat source and sink are commonly delivered by independent fluid flows. Similarly, the source and sink fluid flows are maintained by fluid drive devices such as, but not limited to, pumps, blowers or fans. These propulsion devices, whatever their character, generally require power-consuming motors. The heat delivered by the heat source need not be carried by a fluid flow, but can, in certain embodiments, be delivered directly through a thermal conductor exposed directly to whatever is to be cooled.

In addition, due to the effects of viscosity, the working fluid flowing through a venturi will include boundary-layer regions extending from the boundary walls of the venturi. More particularly, thermal equilibrium at the boundary wall implies the so-called "no-slip" boundary condition, wherein the velocity of the working fluid at the surface of the boundary wall is zero. The no-slip condition, in turn, implies a sharp variation of the macroscopic flow speed across (i.e., transverse to) the flow. The thin region in which this sharp variation occurs is called the boundary layer. Sharp speed variation causes the viscous generation of heat. The interplay among the viscous generation of heat, the conduction of heat by the slowly moving fluid near the boundary wall, and the convection of heat by the rapid axial flow away from the venturi wall determines the variation of the fluid temperature across the boundary layer.

This interplay may limit the transfer of heat into the working-fluid flow. The flow of heat between the boundary wall and the working-fluid flow is affected by the transverse temperature gradient at the venturi wall. In particular, viscous heating causes the sign of this gradient to change as the wall temperature is varied. As the wall temperature is reduced, a temperature is reached for which the transverse temperature gradient vanishes. Further reduction of the wall temperature results in heat transfer from the working fluid into the venturi wall. The temperature at which the transverse temperature gradient changes sign is called the adiabatic or recovery temperature. Temperature recovery across the boundary layer may, in some embodiments, limit the effectiveness of cooling based on the Bernoulli effect.

Figure 5:
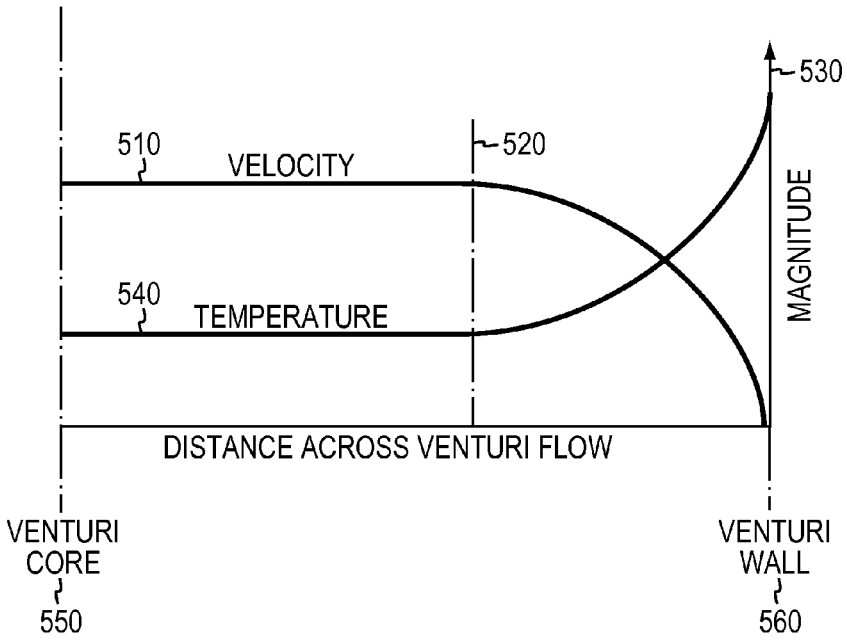
FIG. 5 is a graph showing the relationship between velocity and temperature across a width of a neck portion of a heat transfer system including a venturi flow, in accordance with one embodiment of the invention.

The relative change in velocity and temperature of the working fluid near the boundary wall of a venturi is shown graphically in FIG. 5. More particularly, FIG. 5 shows the magnitude 530 of the velocity 510 of the working fluid decreasing from its free-stream value (in the venturi core 550 above the edge of the boundary layer 520) down to zero at the boundary wall 560 of the venturi. Simultaneously, the graph shows the temperature 540 of the working fluid increasing as it approaches the boundary wall 560 of the venturi.

In various embodiments of the invention, the working fluid may consist essentially of a single fluid component. This fluid component may include, or consist essentially of, a gas such as, for example, air, oxygen, a high-gamma gas, a rare gas, and/or mixtures thereof. In one embodiment the fluid component is a liquid, such as, for example, water. Alternatively, the working fluid may include a plurality of fluid components. In such cases, a heat transfer system incorporating a venturi with a multi-component working fluid flowing therethrough can achieve a greater level of heat transfer than may be achieved using a single, unitary working fluid. In one embodiment, the working fluid includes two separate fluid components. In an alternative embodiment, three or more fluid components are used. By using a working fluid including a plurality of fluid components, the effect of the boundary layer on the transfer of heat from the heat source (in thermal communication with the boundary layer) to the working fluid may be substantially reduced. For example, in one embodiment of the invention, the working fluid includes first and second fluid components, where the first component is lighter than the second component. Upon passing through a neck portion of a venturi having a curved mean flow path, centrifugal force acts on the working fluid to preferentially force the heavier second fluid component towards an outer radial extent of the neck portion, while simultaneously preferentially forcing the lighter first fluid component towards an inner radial extent of the neck portion. This (at least partial) segregation of the fluid components may be utilized, in certain embodiments of the invention, to increase the heat transferred from a heat source to the working fluid within the neck portion.

In one embodiment of the invention, the efficiency of a Bernoulli heat pump is related, at least in part, to the relationship between two diffusive physical effects, namely, thermal conduction and viscous friction, where thermal conduction is the diffusion of energy and viscous friction is the diffusion of momentum. As such, the efficiency of a Bernoulli heat pump may depend, at least in part, on the dimensionless Prandtl number (Pr) of the working fluid flow. The Prandtl number is defined as:

$$P_r = \frac{\mu C_p}{\kappa}$$

where μ is the viscosity, κ is the thermal conductivity, and $C_p$ is the specific heat at constant pressure.

The relevance of the Prandtl number to the efficiency of a Bernoulli heat pump may extend beyond the dimensionless comparison of the diffusion of momentum and energy. An exemplary metric that may be of interest in the context of heat pumps is the coefficient of performance (CoP). The CoP is the ratio of the benefit (i.e., the heat pumped) to the cost (i.e., the power consumed by the pumping). The CoP can be defined for system components and/or for entire systems. For example, in one embodiment, a CoP is calculated for the heat transferred and viscous dissipation occurring in the neck portion of a venturi shaped heat transfer apparatus. Here, CoP is defined as:

$$CoP = \frac{\dot{Q}}{\dot{W}}$$

where $\dot{Q}$ is the heat transferred, and $\dot{W}$ is the power consumed by viscous dissipation in a small region of the flow.

For a small portion of the Venturi wall of area (A), the heat flux $\dot{Q}$ through A is given by the product:

$$\dot{Q} = A\kappa\frac{dT}{dy} \approx A\kappa\frac{T_{wall} - T_{core}}{\lambda_{thermal}}$$

where T is the temperature, y is the distance from the venturi wall, κ is the thermal conductivity and $\lambda_{thermal}$ is the thickness of the thermal boundary layer. In some embodiments, $T_{wall} \approx T_{ambient}$ and isentropic, energy-conserving Bernoulli conversion implies that:

$$C_p(T_{ambient} - T_{core}) = \frac{1}{2}u_{core}^2$$

As a result, $$\dot{Q} = A\kappa \frac{u_{core}^2}{2C_p\lambda_{thermal}}$$

where u is the fluid-flow velocity in the core of the flow.

The corresponding viscous dissipation $\dot{W}$ is given by:

$$\dot{W} = A\int_{BL} dy\mu\left(\frac{du}{dy}\right)^2$$

where the integration is over the velocity boundary layer. With the boundary-layer average:

$$\left\langle \mu\frac{du}{dy}\right\rangle \approx \mu\frac{u_{core}}{2\lambda_{velocity}}$$

it can be found that:

$$\dot{W} = Au_{core}\left\langle \mu\frac{du}{dy}\right\rangle \approx A\mu\frac{u_{core}^2}{2\lambda_{velocity}}$$

Now, as $$\frac{\lambda_{velocity}}{\lambda_{Thermal}} \sim \sqrt{P}:$$

$$CoP = \frac{\dot{Q}}{\dot{W}} \approx \frac{\kappa}{\mu C_p}\sqrt{P_r} = \frac{1}{\sqrt{P_r}}$$

This result describes a homogeneous fluid. Centrifugal force can introduce inhomogeneity in a working fluid by reducing the density of the fluid near a portion of the venturi wall, thereby increasing the thermal conductivity at that wall portion. Note that while the material properties κ, μ, and $C_p$ are appropriate to both the core flow and most of the boundary layer, centrifugal segregation may result in an enhancement of κ in the immediate vicinity of the wall. Incorporating this effect, we have:

$$CoP \approx \left(\frac{\kappa}{\mu C_p}\sqrt{P_r}\right)_{bulk}\frac{M_{bulk}}{M_{wall}} = \frac{1}{\sqrt{P_r^{bulk}}}\frac{M_{bulk}}{M_{wall}}$$

where M is the average particle mass in a given region, and "wall" refer to the fluid in the immediate vicinity of the venturi wall and "bulk" refers to the fluid everywhere else. This relationship shows that the variation of the mass ratio $$\frac{M_{core}}{M_{BL}}$$

may significantly affect the CoP.

For example, ideal gases and pure rare gases all have the same Prandtl number (~⅔). By mixing He with other rare gases, the Prandtl can be reduced from ~⅔ to ~0.2. While the latter variation is quite helpful, the corresponding variation of the thermal conductivity ratio is from 1 to ~30. The origin of the modest variation of the Prandtl number is the fact that both the thermal conductivity and the specific heat are both approximately inversely proportional to the mass. The ratio of the two therefore varies little. Thus, the efficiency of a Bernoulli heat pump may be increased through, for example, increasing the mass ratio.

One embodiment of the invention increases the heat transfer from a heat source in thermal communication with a boundary wall of a heat transfer system with a working fluid flowing therethrough by controlling the mass ratio through, e.g., mass segregation in the boundary layer. For example, Bernoulli heat pumps may be allowed to create and exploit mass-based segregation, or at least partial segregation, of constituents of a multi-component working fluid, with a core working-fluid flow including primarily larger fluid particles of a first fluid component that are separated from the venturi wall by a boundary layer including primarily lighter, more thermally conducting particles of a second fluid component.

Certain venturi-based structures, e.g., with curved flow paths, enable local mass-based segregation of the working fluid into its constituents. This segregation results in a cold, (relatively) slowly flowing fluid in the core of the working-fluid flow separated from the venturi wall by a thin boundary layer preferentially comprising the highly thermally conducting lighter components of one or more second fluid components. The high thermal conductivity enhances heat transfer, while the (relatively) low flow speed of the more massive interior fluid flow component(s) reduces viscous losses in the boundary layer.

Figure 6:
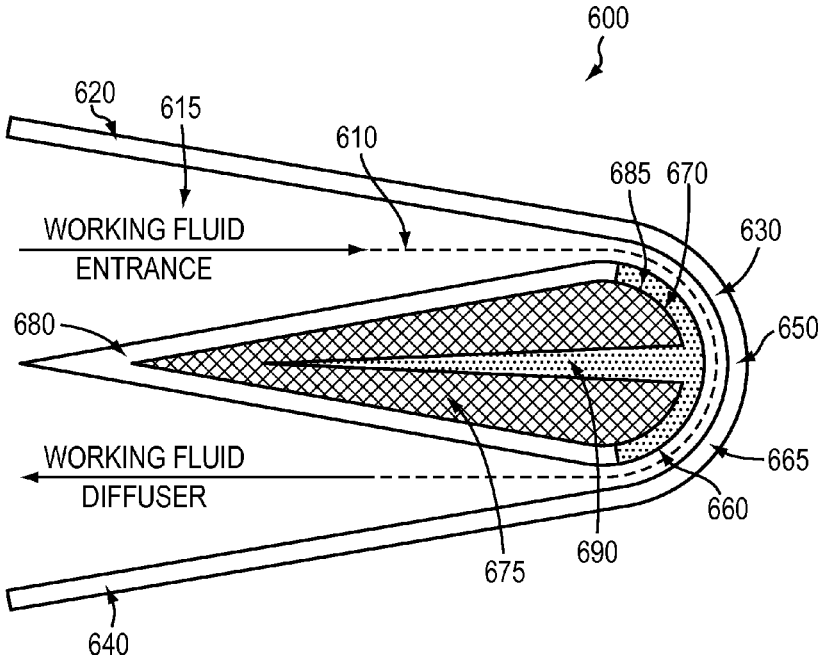
FIG. 6 shows a schematic side view of a heat transfer system having a curved central elongate axis, in accordance with one embodiment of the invention.

One embodiment of the invention, shown in FIG. 6, includes a heat transfer system having a curved mean flow path. The heat transfer apparatus 600 includes a first curved flow path 610 through which at least one working fluid 615 flows. The curved flow path 610 includes an inlet portion 620, a neck portion 630 (e.g., a region of the flow-path with a heat exchanging boundary connecting the region of decreasing cross-sectional area to the region of increasing cross-sectional area) and an outlet portion 640. In one embodiment, the cross-sectional area of the heat transfer apparatus 600 decreases from the inlet portion 620 to the neck portion 630 and increases, after passing through the neck portion 630 or an apex 650 thereof, in the outlet portion 640. The heat transfer apparatus 600 may have any appropriate cross-sectional shape such as, but is not limited to, a circular, oval, square, or rectangular cross-section. For example, the heat transfer apparatus 600 may have a rectangular cross-sectional area having a substantially constant width and a height that varies along the length of the first curved flow path 610. In operation, the curved flow path results in a centrifugal force being applied to the working fluid 615 as it passes through the curved neck portion 630. In one embodiment, the inlet portion 620, a neck portion 630, and outlet portion 640 form a substantially venturi-shaped flow path along the curved mean flow path 610.

As discussed hereinabove, by flowing one or more working fluids 615 through a flow path defined by an inlet portion 620, neck portion 630, and outlet portion 640, the velocity of the working fluid 615 is increased, and the temperature of the working fluid 615 decreased, as the working fluid 615 flows from the inlet portion 620 into the neck portion 630, with the velocity of the working fluid 615 being increased, and the temperature of the working fluid 615 increased, as the working fluid 615 flows from the neck portion 630 and out through the outlet portion 640. By placing a heat source 670 in thermal communication with the neck portion 630, where the heat source 670 is at a higher temperature than the working fluid 615 within the neck portion 630, heat may be transferred, or pumped, from the heat source 670 to the working fluid 615.

In one embodiment, the curved flow path 610 is defined by a first radially curved interior wall portion 660 (e.g. a wall portion defining an inner radial boundary of the curved flow path 610) and a first radially curved exterior wall portion 665 (e.g. a wall portion defining an outer radial boundary of the curved flow path 610). The interior wall portion 660 and exterior wall portion 665 are spaced apart and define the first curved flow path 610 therebetween. A heat source 670 may be placed external to, and in thermal communication with, at least a portion of an inner radial boundary of the first curved flow path 610 (e.g., the interior wall portion 660) such that heat may be transferred from the heat source 670 to the working fluid as it passes through the neck portion 630.

In one embodiment, the working fluid 615 includes at least two fluid components, e.g., a heavier component and a lighter component. In operation, the two fluid components have different masses and thermal conductivities, and a centrifugal force acting on the working fluid 615 within the curved neck portion 630 preferentially forces the lighter component toward the inner radial boundary of the first curved flow path 610 (e.g., the interior wall portion 660), while preferentially forcing the heavier component toward the outer radial boundary of the first curved flow path 610 (e.g., the exterior wall portion 665). This results in the thermal conductivity of the working fluid being increased at the interior wall portion 660 by locally increasing the relative concentration of the lighter component (which has a higher thermal conductivity than the heavier component) near the interior wall portion 660.

At least one of the heavier component or the lighter component may include, or consist essentially of, a gas such as, but not limited to, air, oxygen, and/or a rare gas (such as, but not limited to, helium (He), argon (Ar), or xenon (Xe)). In one exemplary embodiment, the lighter component is He and/or the heavier component is Xe (with the thermal conductivity of He approximately 30 times the thermal conductivity of Xe). In one embodiment, the lighter component has a mole fraction between about 10% and 90% and, e.g., may have a mole fraction of approximately 50%. In another embodiment, the lighter component has a mole fraction between about 55% and 95% and, e.g., may have a mole fraction of approximately 75%.

In one embodiment, at least one of the heavier component or the lighter component may include, or consist essentially of, a liquid such as, but not limited to, water. One or more components of the working fluid may change phase, for example between a liquid and a gas or between a liquid and a solid, along at least a portion of the flow path of the working fluid.

The heat source 670 may be a source of air to be cooled, such as an interior air flow in a building, for an air conditioning system. Alternatively, the heat source 670 may include a recirculating cooling fluid for a mechanical device, a pipe flow in a fluid-transport system (such as, for example, an oil or gas piping system), a mixed-phase fluid flow, or any other appropriate fluid flow or solid heated material requiring cooling. Exemplary heat sources include components for electrical systems and/or vehicles, such as aircraft or ground transportation. In one embodiment, the neck portion 630 is in thermal communication with a single heat source 670. In an alternative embodiment, multiple separate heat sources may be placed in thermal communication with at least a portion of the inner radial boundary of the first curved flow path 610.

In the illustrated implementation, the heat source 670 includes a heat-source fluid 675 travelling along a heat-source flow path. This heat source flow path may, for example, extend along a flow-separation element 680, or a portion thereof, which houses the heat source flow and defines at least a portion of the first radially curved interior wall portion 660. For example, the heat-source flow path may extend substantially perpendicular to the first flow path 610 within a flow-separation element 680 that itself extends substantially perpendicular to the first flow path 610 across a width of the heat transfer apparatus 600.

In one embodiment, at least a portion of the curved interior wall portion 660 includes, or consists essentially of, a material having a high thermal conductivity (e.g., a material having a thermal conductivity exceeding that of one or more surrounding materials in thermal communication with the high-thermal-conductivity material and/or working fluid). This high-thermal conductivity portion 685 may provide a shared-wall boundary separating the heat source 670 from the working fluid 615 while preferentially allowing heat to be pumped from the heat source 670 to the working fluid 615 through the high-thermal-conductivity portion 685. Other portions of the walls defining the first flow path 610, such as the curved exterior wall portion 665 and/or a wall portion of the flow-separation element 680 away from the neck portion 630 may include, or consist essentially of, a material having a lower thermal conductivity than the high-thermal-conductivity portion 685 of the curved interior wall portion 660.

The curved interior wall portion 660 may have one or more heat-conducting structures 690 extending from at least one location on the curved interior wall portion 660 (such as from the apex 650 of the neck portion 630) into the heat-source flow path. The heat-conducting structure 690 increases the surface area available for conducting heat from the heat source fluid 675 to the working fluid 615. The heat-conducting structure 690 may include one or more fins, grids, or combinations thereof. The heat-conducting structure 690, or fins, may be of a size, shape and configuration to increase the transfer of heat from the heat source 670 to the working fluid 615. For example, the heat-conducting structure 690 may be an elongate element extending along an axis transverse to the first flow path 610. The heat-conducting structure 690 may extend across the entire width of the heat transfer apparatus 600, or extend across a portion thereof. The heat-conducting structure 690 may be formed from the same material as the wall portion from which it extends, or be formed from a different material. For example, the heat-conducting structure 690 may include, or consist essentially of, the same high thermal conductivity material as the high-thermal-conductivity portion 685 of the radially curved interior wall portion 660.

In operation, the working fluid 615, including at least one heavier fluid component and at least one lighter fluid component, is driven into the inlet portion 620 of the heat transfer apparatus 600. The working fluid accelerates, and simultaneously drops in temperature, as it traverses the fluid flow path 610 towards the neck portion 630. As the working fluid 615 flows through the neck portion 630, it follows a curved flow path 610 defined by the first radially curved interior wall portion 660 and a first radially curved exterior wall portion 665. As a result of this curvature, the working fluid 615 experiences a centrifugal force as it follows the curved flow path 610 through the neck portion 630. The centrifugal force preferentially forces the heavier fluid component(s) towards the first radially curved exterior wall portion 665, with the lighter component(s) being preferentially forced towards the first radially curved interior wall portion 660. This results in (at least partial) segregation of the lighter and heavier working fluid components, with a relatively higher concentration of the lighter fluid component near the first radially curved interior wall portion 660, and with a relatively higher concentration of the heavier fluid component near the first radially curved exterior wall portion 665.

The mass-based segregation of the working fluid 615 components is beneficial in increasing the heat transfer between a heat source 670 and the working fluid 615. By selecting working fluid components such that the lighter components have a higher thermal conductivity than the heavier components, the increased relative concentration of the lighter components towards the inner radial boundary 660 of the curved flow path 610 increases the heat transfer between a heat source 670 in thermal communication with the inner radial curved boundary 660.

In one embodiment, the lighter fluid component may be He, while the heavier fluid component is Xe. In alternative embodiment, other rare gases may be used for one or both of the fluid components. In further alternative embodiments, any mixture of gases and/or liquids having different masses may be used for the at least one lighter component and/or at least one heavier component. The mole fraction of the lighter component may be approximately 75%±20%. The speed of the flow within the neck portion may be approximately M (Mach Number)=0.8±0.3. The thickness of the boundary layer within the neck portion may be from approximately 10 microns to approximately 100 microns. In various embodiments the amplitude and radius of the curvature of the neck portion of the curved venturi shaped flow path is less than 1000 times the boundary-layer thickness, but this is not mandatory; depending on the particular geometry and flow conditions within the flow path the boundary-layer thickness may be higher or lower.

The curved flow path 610 traverses an angle of 180°, with the flow-separation element 680 separating the inlet portion 620 from the outlet portion 640. In an alternative embodiment, the curved flow path 610 may traverse any appropriate angle of curvature from 0° to 180°, or more. The tortuous flow path may, depending on the application, traverse a plurality of curves. As in previously described embodiments, the heat transfer apparatus 600 may form part of a closed-loop or open-loop heat transfer system.

In one embodiment, the curved flow path 610 is defined by a substantially cylindrical wall with an oval or substantially circular cross-section. In this embodiment, the first radially curved interior wall portion 660 forms the inner half of the circular cross-section, with the first radially curved exterior wall portion 665 forming the outer half of the circular cross-section. These inner and outer portions join to form a single contiguous wall defining the curved flow path 610. In an alternative embodiment of the invention a cross-section of the boundary defining the curved flow path 610 may be of any shape such as, but not limited to, square, rectangular or any other polygonal shape. In one embodiment, a cross-section of the boundary of the curved flow path 610 may include a plurality of curved and/or flat wall portions, with high thermal conductivity portions 685 forming part of any one or more of the inner wall portions of the heat-transfer apparatus 600.

Figure 7:
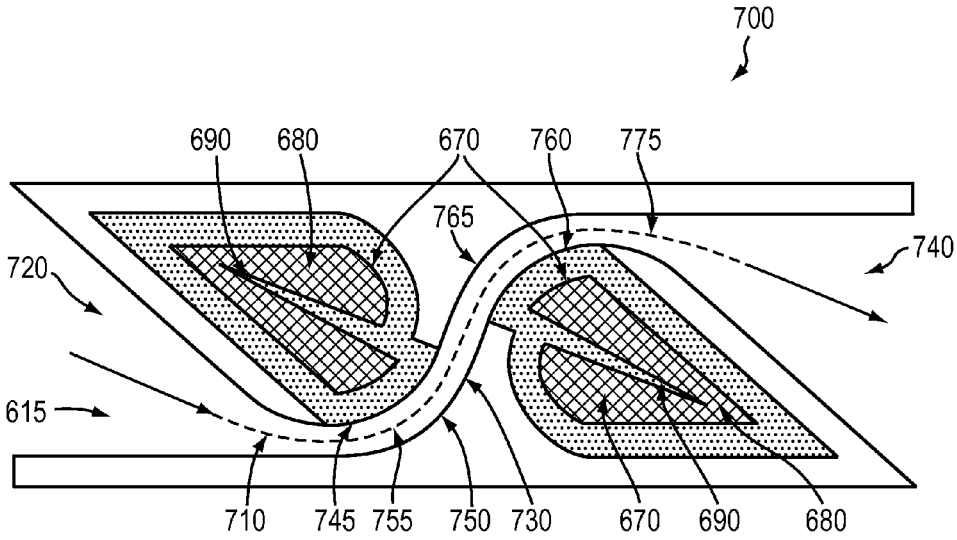
FIG. 7 shows a schematic side view of another heat transfer system having a curved central elongate axis, in accordance with one embodiment of the invention.

An embodiment 700 having a tortuous flow path 710 with a plurality of curves is illustrated in FIG. 7. At least one working fluid 615 having lighter and heavier components flows through the tortuous flow path 710, which includes an inlet portion 720, an extended tortuous neck portion 730 and an outlet portion 740. Providing more than one curved portion within the extended neck portion 740 allows a plurality of heat sources 670 to be placed in thermal communication with a boundary of the tortuous flow path 710.

The heat transfer apparatus 700 includes a first radially curved interior wall portion 745 and a first radially curved exterior wall portion 750 defining a first curved portion 755 of the tortuous flow path 710, and a second radially curved interior wall portion 760 and a second radially curved exterior wall portion 765 defining a second curved flow path 775. The second radially curved interior wall portion 760 extends from the first radially curved exterior wall portion 750 and the second radially curved exterior wall portion 765 extends from the first radially curved interior wall portion 745 so that the first curved flow portion 755 and second curved flow portion 775 connect to define the single tortuous flow path 710 from the inlet portion 720 to the outlet portion 740. The working fluid 615 experiences centrifugal force so as to preferentially force the lighter component toward the first interior wall portion 745 along the first curved flow portion 755 and toward the second interior wall portion 760 along the second curved flow portion 775.

As described above, each heat source 670 may include a heat-source fluid 680 travelling along a heat-source flow path and in thermal communication with the working fluid 715 within the tortuous flow path 710 through a shared-wall, high-thermal-conductivity portion 785. One or more heat-conducting structures 690 may extend from at least one location on one or more of the curved interior wall portions 645, 660 into the heat-source flow path.

Figure 8A:
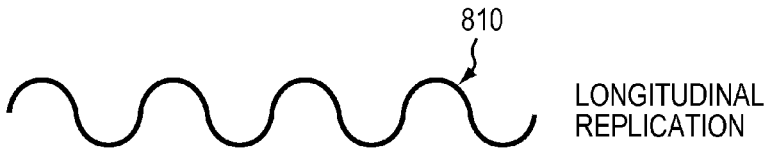
FIG. 8A shows an exemplary curved central elongate axis for a heat transfer system, in accordance with one embodiment of the invention.
Figure 8B:
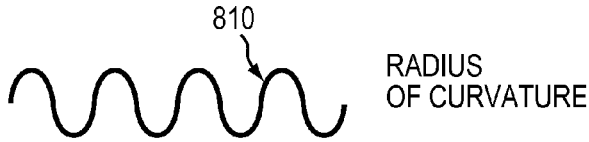
FIG. 8B shows another exemplary curved central elongate axis for a heat transfer system, in accordance with one embodiment of the invention.
Figure 8C:
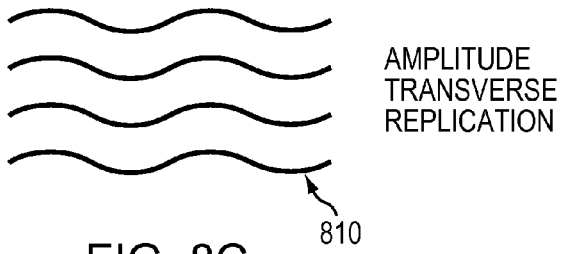
FIG. 8C shows yet another exemplary curved central elongate axis for a heat transfer system, in accordance with one embodiment of the invention.

By locating a plurality of curved flow portions along a tortuous flow path, with each curved portion including a radially interior boundary wall in thermal communication with a heat source, the heat transfer between a heat source and a working fluid may be increased and/or heat may be transferred from multiple heat sources to a single working fluid flow. In various embodiments, a tortuous flow path may include any number of curved flow portions, with each flow portion traversing any appropriate angle (up to, or greater than 180°) and/or any appropriate radius or curvature. Exemplary tortuous flow paths 810, including various angles and radius of curvature, are shown schematically in FIGS. 8A-8C. FIG. 8C shows a plurality of substantially identical adjacent tortuous flow paths 810, which allow for parallel fluid flows and the attendant system capacity increases and additional locations for enhanced heat transfer.

Figure 9:
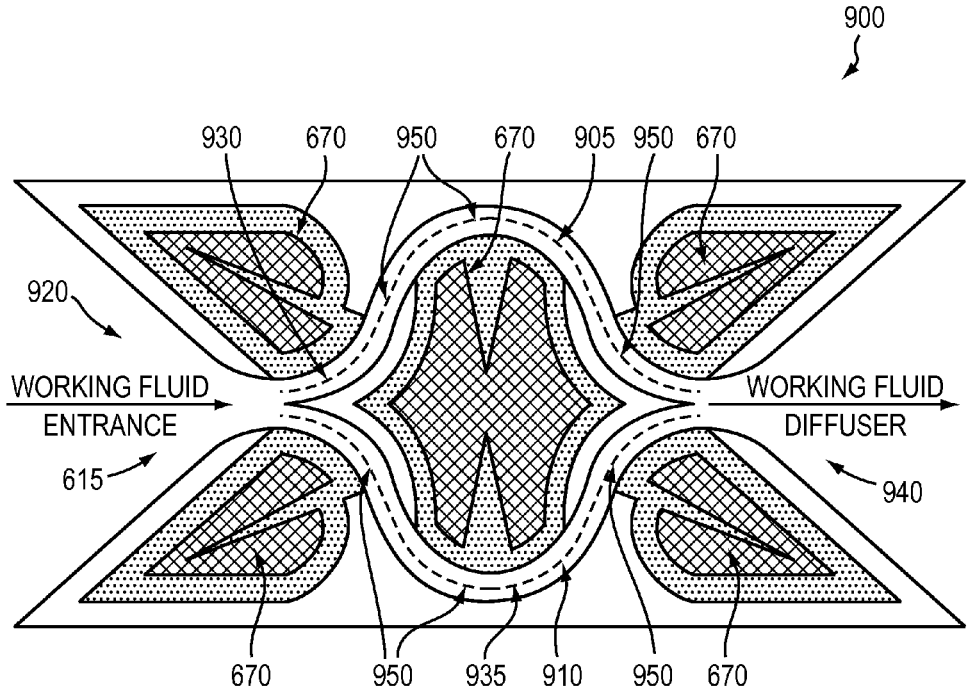
FIG. 9 shows a schematic side view of another heat transfer system having a curved central elongate axis, in accordance with one embodiment of the invention.

An exemplary heat transfer system 900 including two substantially identical tortuous flow paths 905, 910 extending between an inlet portion 920 and an outlet portion 940 along two neck portions 930, 935 arranged symmetrically about an axis of symmetry is shown in FIG. 9. Each of the tortuous flow paths 905, 910 includes a plurality of curved portions 950, with each curved portion 950 applying a centrifugal force to a multi-component working fluid 615 flowing therealong. By locating heat sources 670 at one or more of the inner radial boundaries of each of these curved portions 950, heat may be transferred from the heat sources 670 to the working fluid 615 as described above. In an alternative embodiment, additional and/or different tortuous flow paths may be included within the heat transfer system to provide additional and/or different locations for enhanced heat transfer.

Figure 10A:
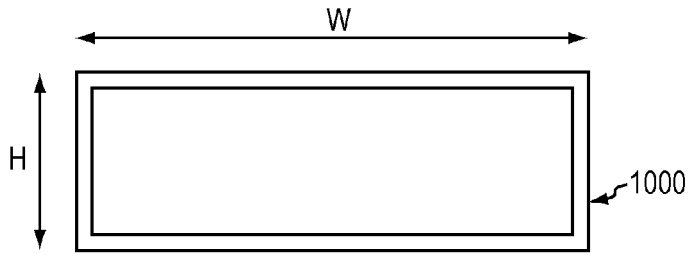
FIG. 10A shows a cross-section of a flow channel without additional heat-conducting surfaces, in accordance with one embodiment of the invention.
Figure 10B:
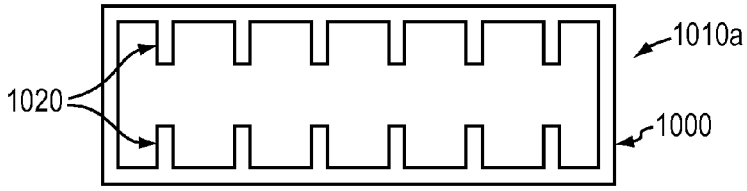
FIGS. 10B-10D show cross-sections of flow channels with additional heat-conducting surfaces placed therein, in accordance with one embodiment of the invention.
Figure 10C:
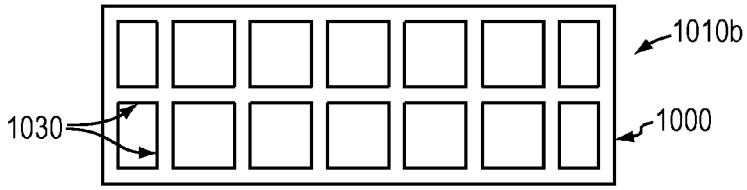
Figure 10D:
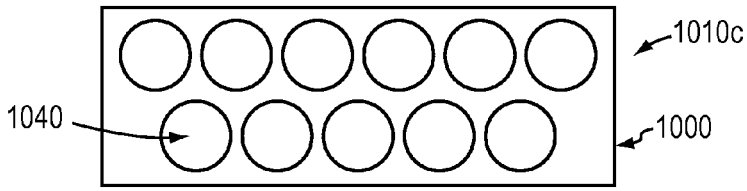

In various embodiments of the invention, one or more heat-conducting structures may be positioned within a heat-source fluid flow path and/or within a working fluid flow path. Exemplary heat-conducting structures 1010 extending from a flow-path boundary wall 1000 are shown in FIGS. 10B-10D, with a boundary wall 1000 free from additional heat-conducting structures shown in FIG. 10A. FIG. 10B shows a heat-conducting structure 1010*a* formed as a plurality of fins 1020. These fins 1020 may be of any appropriate height, width, and shape, (e.g. to provide the greatest surface area for heat transfer between a fluid flowing within the channel and the boundary wall 1000 without significantly disturbing the fluid flow within the boundary wall 1000) and may extend either along the entire length of the flow channel wall 1000, or along a portion thereof. In one embodiment, a single fin 1020 may extend from the wall 1000. In alternative embodiments, a plurality of fins 1010*a* may extend from one or more cross-sectional positions on the boundary wall 1000.

FIG. 10C shows a heat-conducting structure 1010*b* formed from a grid of elongate elements 1030 extending between various locations on the boundary wall 1000. Each element 1030 may be of any appropriate width, and shape, (e.g. to provide the greatest surface area for heat transfer between a fluid flowing within the channel and the boundary wall 1000 without significantly disturbing the fluid flow within the boundary wall 1000) and may extend either along the entire length of the flow channel wall 1000, or along a portion thereof. The grid 1010*b* may also include any appropriate number of elements 1030 to provide the required heat conducting surface area and structural properties necessary. The grid 1010*b* may extend over the entire cross-section of the boundary wall 1000, or only a portion thereof.

FIG. 10D shows a heat-conducting structure 1010*c* formed from a structure with a plurality of flow channels 1040 therethrough. The heat-conducting structure 1010*c* may, for example, include one of more plates or blocks through which the flow channels 1040 are formed. The size, shape, quantity, and location of the flow channels 1040 may again be selected to provide the greatest surface area for heat transfer between a fluid flowing within the channel and the boundary wall 1000 without significantly disturbing the fluid flow within the boundary wall 1000. The heat-conducting structure 1010*c* may extend either along the entire length of the flow channel wall 1000, or along a portion thereof.

The boundary wall 1000 may form a portion of a working fluid flow path and/or a heat-source fluid flow path. For example, the boundary wall 1000 may form the neck portion of a substantially linear and/or curved venturi shaped flow path for any of the heat transfer systems described herein. The boundary wall 1000 may have any appropriate width "W" and height "H". In alternative embodiments, the boundary wall 1000 may form a circular, oval, or polygonal cross-section for a fluid flow path.

In one embodiment, a heat-conducting structure 1010 is configured such that the heat-conducting structure 1010 reduces the cross-sectional area of the flow path within the boundary wall 1000 such that it forms a neck portion of a substantially venturi shaped flow. That is, the axial variation of the cross-sectional area within the heat-conducting structure 1010 may constitute the venturi neck.

Figure 11:
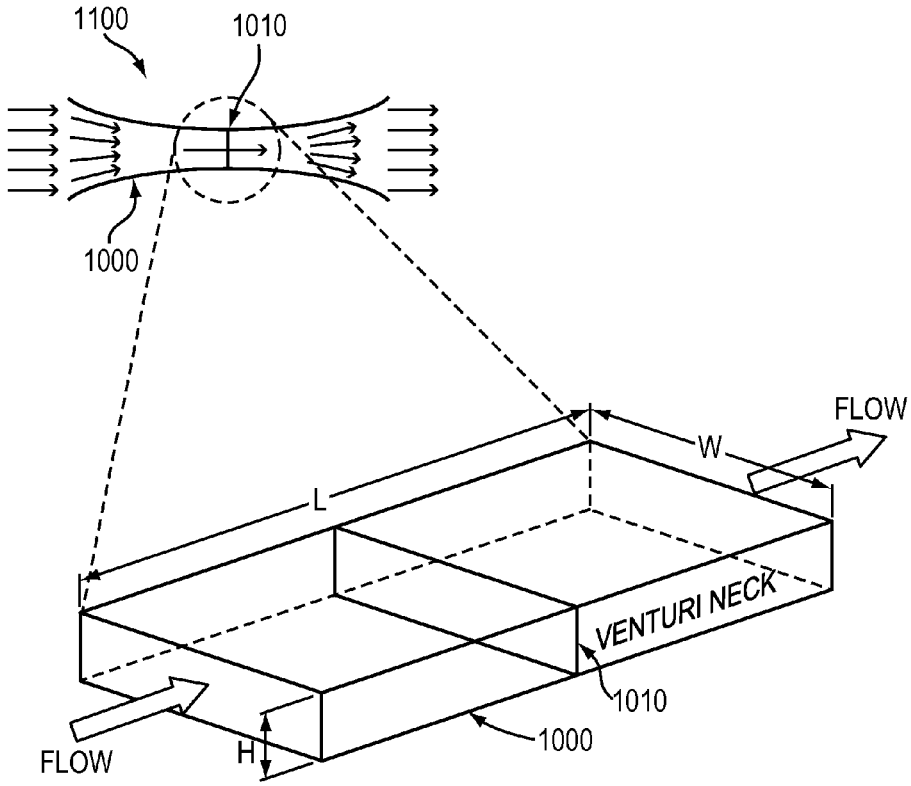
FIG. 11 shows a section of a venturi shaped flow channel, in accordance with one embodiment of the invention.

An example neck portion 1100 with a heat-conducting structure 1010 positioned therein is shown in FIG. 11. In this embodiment, the heat-conducting structure 1010 extends from a boundary wall 1000 of the neck portion 1100, and increases the surface area of the heat transferring surface between a working fluid flowing through the neck portion and a heat source in thermal communication with the boundary wall 1000. In alternative embodiments, a plurality of heat-conducting structures 1010 may be located at various positions along a length "L" of the flow path.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A heat transfer apparatus, comprising:

a first radially curved interior wall portion;

a first radially curved exterior wall portion, the interior and exterior wall portions being spaced apart and curved in the same radial direction to define a first curved flow path therebetween;

a first heat source external to and in thermal communication, with at least a portion of the curved interior wall portion; and a working fluid, comprising a heavier component and a lighter component, flowing through the first curved flow path, whereby the working fluid experiences centrifugal force so as to preferentially force the heavier component toward the exterior wall portion and thereby cause the lighter component to preferentially absorb heat from the interior wall portion.

2. The apparatus of claim 1, further comprising a second radially curved interior wall portion and a second radially curved exterior wall portion defining a second curved flow path, the second radially curved interior wall portion extending from the first radially curved exterior wall portion and the second radially curved exterior wall portion extending from the first radially curved interior wall portion so that the first and second flow paths define a single tortuous flow path, whereby the working fluid experiences centrifugal force so as to preferentially force the lighter component toward the first interior wall along the first flow path and toward the second interior wall along the second flow path.

3. The apparatus of claim 2, wherein the first radially curved interior wall portion and the second radially curved exterior wall portion are collectively a portion of a unitary first structure, and the first radially curved exterior wall portion and the second radially curved interior wall portion are collectively a portion, of a unitary second structure.

4. The apparatus of claim 3, wherein the first and second structures have substantially symmetric cross-sections.

5. The apparatus of claim 1, wherein the first flow path defines a venturi shape.

6. The apparatus of claim 1, wherein at least a portion of the curved interior wall portion comprises a material having a high thermal conductivity.

7. The apparatus of claim 6, wherein the curved exterior wall portion comprises a material having a lower thermal conductivity than the curved interior wall portion.

8. The apparatus of claim 1, wherein at least one of the heavier component or the lighter component comprises at least one of a liquid and a gas.

9. The apparatus of claim 8, wherein the gas is selected from the group consisting of air, oxygen, a rare gas, and mixtures thereof.

10. The apparatus of claim 9, wherein the rare gas comprises helium or xenon.

11. The apparatus of claim 9, wherein the lighter component comprises helium.

12. The apparatus of claim 9, wherein the heavier component comprises xenon.

13. The apparatus of claim 8, wherein the lighter component has a mole fraction between 55% and 95%.

14. The apparatus of claim 13, wherein the lighter component has a mole fraction of approximately 75%.

15. The apparatus of claim 1, further comprising a drive system for driving the working fluid through the first flow path.

16. The apparatus of claim 15, wherein the drive system drives the working fluid through the first flow path at a core velocity of between 0.5 and 1.1 times the speed of sound of the working fluid.

17. The apparatus of claim 16, wherein the drive system drives the working fluid through the first flow path at a core velocity of approximately 0.8 times the speed of sound of the working fluid.

18. The apparatus of claim 1, wherein the first heat source comprises a heat-source flow path.

19. The apparatus of claim 18, wherein the heat-source, flow path extends substantially perpendicular to the first flow path.

20. The apparatus of claim 18, wherein the interior wall portion comprises at least one heat-conducting structure extending into the heat-source flow path.

21. The apparatus of claim 20, wherein the heat-conducting structure extends along an axis transverse to the flow path, the first radially curved exterior wall portion also extending along the transverse axis.

22. The apparatus of claim 20, wherein the heat-conducting structure comprises a material having a high thermal conductivity.

23. The apparatus of claim 1, further comprising means defining a return flow path to transport the working fluid from an exit, of the first flow path back to an entrance of the first flow path.

24. The apparatus of claim 23, wherein the curved flow path and return flow path define a closed loop.

25. The apparatus of claim 23, wherein the return flow path comprises a heat exchanger.

26. The apparatus of claim 25, wherein the heat exchanger removes heat from the working fluid.

27. The apparatus of claim 1, wherein the curved flow path comprises an open loop.

28. A method of transferring heat, comprising:

providing a first curved flow path defined by an interior wall portion and an exterior wall portion, wherein the interior and exterior wall portions are curved in the same radial direction;

providing a first heat source external to and in thermal communication with at least a portion of an inner radial boundary of the first curved flow path; and flowing a working fluid, comprising a heavier component and a lighter component, through the first flow path, whereby the working fluid experiences centrifugal force so as to preferentially force the heavier component toward an exterior radial boundary of the first curved flow path and thereby cause the lighter component to preferentially absorb heat from the inner radial boundary.

29. The method of claim 28, wherein the first curved flow path comprises a first radially curved interior wall portion and a first radially curved exterior wall portion, the interior and exterior wall portions being spaced apart and defining the first curved flow path therebetween.

30. The method of claim 29, wherein the first radially curved interior wall portion defines the inner radial boundary of the first curved flow path.

31. The method of claim 29, further comprising: providing a second radially curved interior wall portion and second radially curved exterior wall portion defining a second curved flow path, the second radially curved interior wall portion extending from the first radially curved exterior wall portion and the second radially curved exterior wall portion extending from the first radially curved interior wall portion so that the first and second flow paths define a single tortuous flow path, whereby the working fluid experiences centrifugal force so as to preferentially force the lighter component toward the first interior wall along the first flow path and toward the second interior wall along the second flow path.

32. The method of claim 31, wherein the first radially curved interior wall portion and the second radially, curved exterior wall portion are collectively a portion of a unitary first structure, and the first radially curved exterior wall portion and the second radially curved interior wall portion are collectively a portion of a unitary second structure.

33. The method of claim 32, wherein the first and second structures have substantially symmetric cross-sections.

34. The method of claim 29, wherein at least a portion of the curved interior wall portion comprises a material having a high thermal conductivity.

35. The method of claim 29, wherein the curved exterior wall portion comprises a material having a lower thermal conductivity than the curved interior wall portion.

36. The method of claim 29, wherein the interior wall portion comprises at least one heat-conducting structure extending into the heat-source flow path.

37. The method of claim 36, wherein the heat-conducting structure extends along an axis transverse to the flow path.

38. The method of claim 36, wherein the heat-conducting structure comprises a material having a high thermal conductivity.

39. The method of claim 28, wherein the first flow path defines a venturi shape.

40. The method of claim 28, wherein at least one of the heavier component or the lighter component comprises at least one of a liquid and a gas.

41. The method of claim 40, wherein the gas is selected from the group consisting of air, oxygen, a rare gas, and mixtures thereof.

42. The method of claim 41, wherein the rare gas comprises helium or xenon.

43. The method of claim 42, wherein the lighter component comprises helium.

44. The method of claim 42, wherein the heavier component comprises xenon.

45. The method of claim 42, wherein the lighter component has a mole fraction between 55% and 95%.

46. The method of claim 40, wherein the lighter component has a mole fraction of approximately 75%.

47. The method of claim 28, further comprising providing a drive system for driving the working fluid through the first flow path.

48. The method of claim 47, wherein the drive system drives the working fluid through the first flow path at a core velocity of between 0.5 and 1.1 times the speed of sound of the working fluid.

49. The method of claim 48, wherein the drive system drives the working fluid through the first flow path at a core velocity of approximately 0.8 times the speed of sound of the working fluid.

50. The method of claim 28, wherein the first heat source comprises a heat-source flow path.

51. The method of claim 50, wherein the heat-source flow path extends substantially perpendicular to the first flow path.

52. The method of claim 28, wherein a return flow path transports the working fluid from an exit of the first flow path back to an entrance of the first flow path.

53. The method of claim 52, wherein the curved flow path and return flow path define a closed loop.

54. The method of claim 52, wherein the return flow path comprises a heat exchanger.

55. The method of claim 52, wherein the heat exchanger removes heat from the working fluid.

56. The method of claim 28, wherein the curved flow path comprises an open loop.

* * * * *

UNITED STATES PATENT AND TRADEMARK OFFICE

CERTIFICATE OF CORRECTION

PATENT NO. : 8,281,605 B2
APPLICATION NO. : 12/420510
DATED : October 9, 2012
INVENTOR(S) : Arthur R. Williams and Charles Agosta It is certified that error appears in the above-identified patent and that said Letters Patent is hereby corrected as shown below:

On the title page item (73), should read: (73) Assignee: Machflow Energy, Inc.

Signed and Sealed this
Twenty-second Day of January, 2013

David J. Kappos

David J. Kappos
*Director of the United States Patent and Trademark Office*